United States Patent [19]

Farrell

[11] Patent Number: 5,027,536

[45] Date of Patent: Jul. 2, 1991

[54] SNOWPLOW MOUNTING APPARATUS

[75] Inventor: Eugene A. Farrell, Fishers Landing, N.Y.

[73] Assignee: Cives Corporation, Roswell, Ga.

[21] Appl. No.: 612,081

[22] Filed: Nov. 13, 1990

[51] Int. Cl.[5] ..... E01H 5/04

[52] U.S. Cl. ..... 37/236; 37/231

[58] Field of Search ..... 37/231, 234, 235, 236, 37/117.5, DIG. 12

[56] References Cited

U.S. PATENT DOCUMENTS

| | | | |
|---|---|---|---|
| 4,268,058 | 5/1981 | Farrell et al. | 37/231 X |
| 4,436,477 | 3/1984 | Lenertz et al. | 37/117.5 X |
| 4,480,955 | 11/1984 | Andrews et al. | 37/117.5 X |
| 4,597,205 | 7/1986 | Guest | 37/117.5 X |
| 4,769,933 | 9/1988 | DeJana | 37/231 |
| 4,833,799 | 5/1989 | Harte et al. | 37/231 |
| 4,962,599 | 10/1990 | Harris | 37/231 X |

*Primary Examiner*—Dennis L. Taylor
*Assistant Examiner*—J. Russell McBee
*Attorney, Agent, or Firm*—Wall and Roehrig

[57] ABSTRACT

A snowplow mounting apparatus for use on trucks and the like is provided in which a pair of clam-shell plates are mounted on the front of the truck in place of the usual bumper. The plates are pivotally joined together at the top. The removed bumper is mounted on the outer plate of the clam-shell and the actuating hydraulic cylinder is mounted within the clam-shell where it is fully protected. The plow blade is mounted on the outer clam-shell with a quick disconnect feature and a pair of cam surfaces is mounted on the inside of the clam-shell plates. The hydraulic cylinder through cam followers cooperatively engaging said cam surfaces force the plates apart about the pivot point of the clam-shell which raises the plow from engagement with the surface being plowed. The entire mounting apparatus being positioned in place of the bumper, with the bumper on the front of it offers a clean, unobstructed front bumper for the truck that will function as the original bumper was intended to function without interfering protrusions extending forward of the front bumper when the plow blade apparatus is removed.

9 Claims, 4 Drawing Sheets

SNOWPLOW MOUNTING APPARATUS

BACKGROUND OF THE INVENTION

This invention relates to mounting snowplows on trucks, and more particularly to an apparatus for mounting a removable snowplow blade on a truck so that the blade can be fully actuated and operated for plowing operations and later completely removed leaving the front bumper fully functional in its intended fashion without interference from protruding, mounting and control apparatus.

Various methods and apparatus for attaching a snowplow to a truck for plowing of snow and the like have been used over the years. Generally, they have taken the form of a framework, attached to the frame of the truck, which carries the plow in a pivotally adjustable fashion on the front thereof. The plow is detachably mounted on the framework so as to transfer the force of the plowing directly to the truck frame. A hydraulic cylinder to actuate the plow from plowing to raised condition, has generally been secured to the framework with various mounting brackets and arms extending therefrom to attach a chain or other means for lifting the plow blade in and out of contact with the ground. Generally, when the plow blade has been removed from this type of installation, it has left the hydraulic cylinder and the other various arms and brackets extending forward of the bumper of the truck so as to be a hazard to another vehicle or building when the truck's bumper contacts such an object.

OBJECTS AND SUMMARY OF THE INVENTION

Accordingly, it is an object of the present invention to provide an apparatus and method of mounting a plow on a truck that overcomes the shortcomings of the prior art.

It is another object of the invention to provide an apparatus and method for mounting a plow on a truck that permits use of the standard front bumper of the truck in its intended fashion after disconnecting of the plow blade.

It is a further object of the present invention to provide a novel clam-shell plow mounting apparatus for use on trucks in which the actuating cylinder is concealed within a protective enclosure after the plow blade has been removed.

It is yet another object of the present invention to provide a quick detachable plow blade and mounting assembly in which the quick attachment and detachment feature is built into the mounting apparatus.

It is yet a further object of the present invention to provide a snowplow mounting and control apparatus in which the control cylinder operates through a plurality of cam surfaces and cam followers to raise and lower the plow blade from the road surface.

It is a still further object of the present invention to provide a clam-shell mounting apparatus for a snowplow which can be mounted on the front of a truck in place of the normal bumper, and carry thereon the truck bumper normally mounted on the truck itself, and in which the clam-shell can be opened by a hydraulic cylinder mounted therein to raise and lower the plow blade.

In one embodiment of the present invention, this is accomplished by providing a pair of mounting plates pivoted along the upper edge to form a clam-shell configuration. The outer clam-shell carries the removable plow blade and the inner clamshell is mounted on the truck. A hydraulic actuating cylinder is mounted in the clam-shell to raise and lower the blade through a cam and follower assembly mechanism.

BRIEF DESCRIPTION OF THE DRAWINGS

These and other and further objects of the invention, together with additional features and advantages accruing therefrom will be apparent from the following description of the invention which is shown in the accompanying drawings in which.

DETAILED DESCRIPTION OF THE PREFERRED EMBODIMENT

Figure 1:
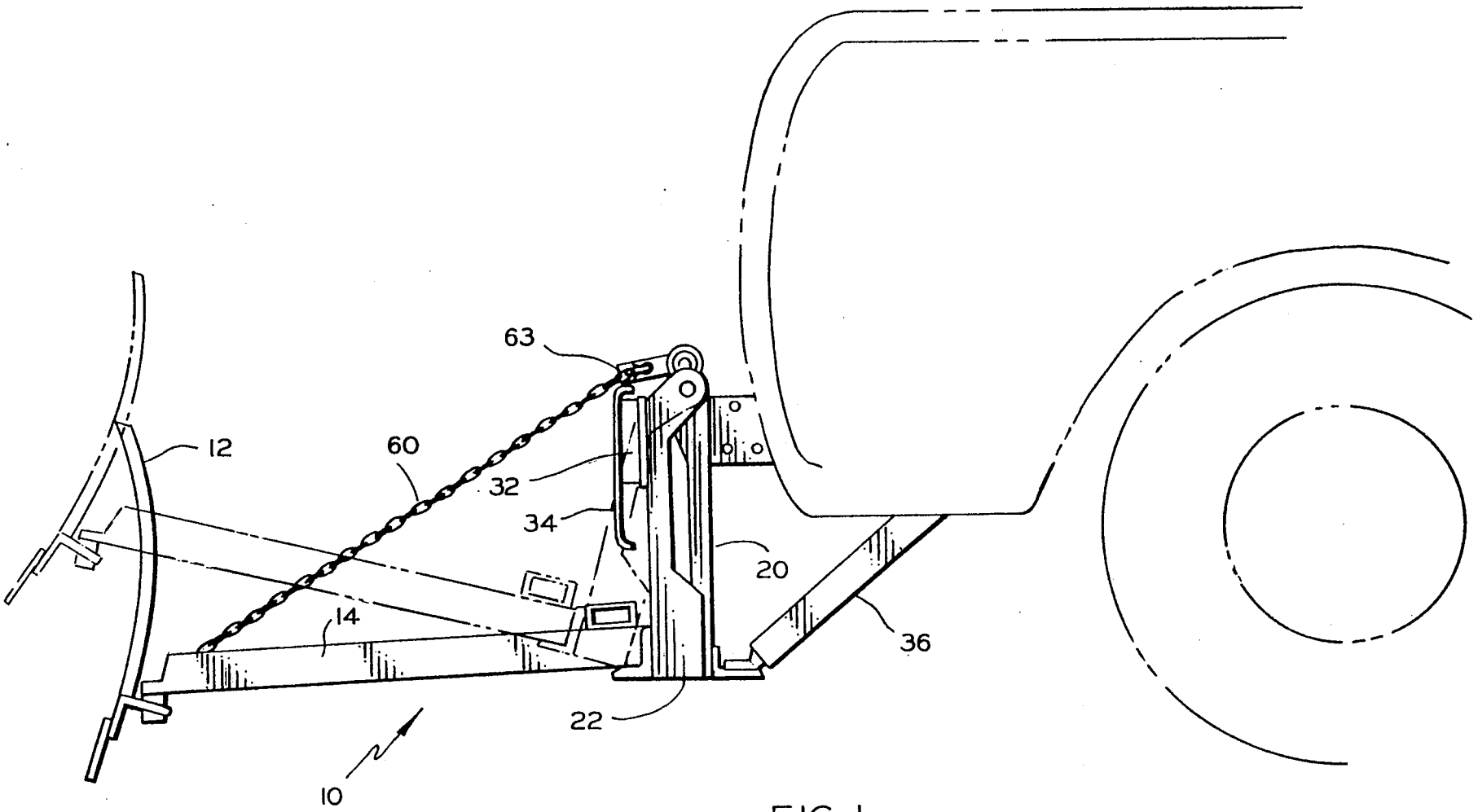
FIG. 1 is a side elevation of the apparatus according to the present invention installed on the front of a truck.
Figure 2:
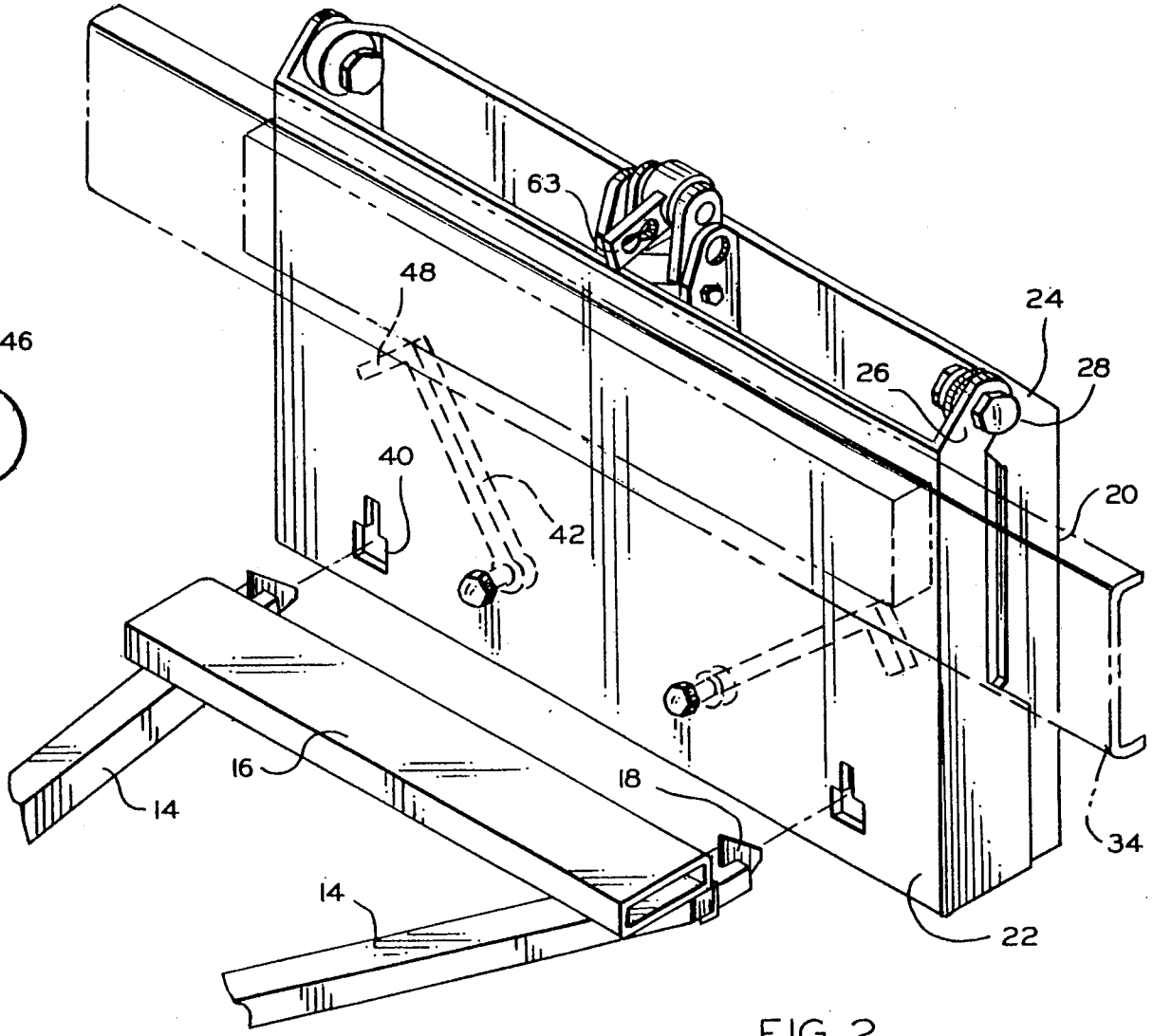
FIG. 2 is a perspective view, partially broken away, of the clam-shell mounting plate arrangement of the present invention.

Referring now to FIG. 1, the snowplow mounting apparatus 10 includes a snowplow blade 12, attaching frame members 14 fastened at one end to the blade and at the other to a spreader bar 16 (FIG. 2). The frame members 14 have extending from the inner ends thereof bayonet or plow attaching ears 18 adapted to be engaged in the outer clam-shell mounting plate, as will be described herein.

The basic mounting apparatus for the plow assembly includes a pair of clam-shell plates 20 and 22 (FIGS. 2 and 3) which are generally rectangular in shape and have side flanges disposed at 90 degrees to the plates at each end thereof. The side flanges include ears 24 and 26 which have holes therein which are adapted to mate with each other about a bolt 28 for pivotal motion of one plate relative to the other. Plate 20 has mounted on the back thereof one or more brackets 30 (FIG. 4) which are adapted to mate with the bumper mounting structure of the particular truck, make and model on which the plow is to be mounted. The brackets 30 are bolted to the frame of the truck after removal of the normal front bumper from the truck.

The plate 22 carries on its front or outer surface a series of mounting brackets 32 for mounting thereon of the original bumper taken off the truck during the installation of the mounting apparatus. The front bumper is shown at 34 as representative of the type of installation involved. Bumper 34 is shown in dotted lines on FIG. 2 to show its approximate location to match the height and function originally intended for the bumper when it was mounted directly on the truck.

Figure 5:
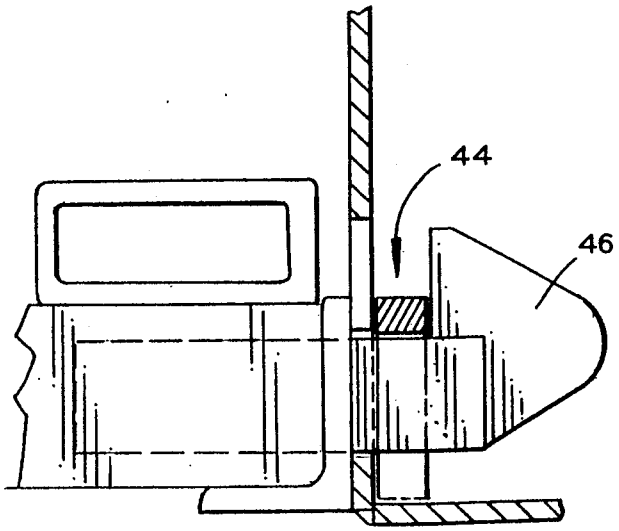
FIG. 5 is a detailed partial sectional view of the detachable mounting for the plow blade.

The fixed clam-shell 20, when it is mounted through the brackets 30 to the bumper frame, is supported at the lower end thereof with a brace 36 secured to the truck frame so as to support the clam-shell 20 for carrying of the plow blade and for transferring the plowing force directly to the frame of the truck, as is customary in the art. The other clam-shell 22, which is the forward facing shell, has formed therein a pair of T-shaped slots 40 which are adapted to receive therein the bayonets 18 to releasably secure the frame members 14 of the apparatus 10 to the clam-shell 22. The bayonets 18 are inserted through the slots 40 and are held therein by pivotally mounted L-shaped bars 42 which are pivoted down to interlock behind the tip of the arrow head of the bayonet 18. This may be seen in detail in FIG. 5, and in general in FIGS. 2 and 3. The L-shaped bars 42 are rectangular in cross-section and drop into the slot 44 formed by the arrow head 46 of the bayonet 18. The short leg 48 of the L rests on the inwardly turned foot 23 of the plate 22 to securely hold the frame member 14 in the plate 22. The leg 48 of the lever 42, by resting on the bottom flange of the plate 22 keeps lever 42 from falling down onto the roadway or otherwise interfering with the operation of the apparatus either when the plow is installed, or when the plow has been removed.

The arms 42 are pivotally mounted about the end of the long leg by a ferrule 50, welded thereto, which fits over a stud 54 and is held thereon by a cotter pin or other suitable fastener 56. Any conventional mounting means that allows pivotal movement of the arms 42 can be used.

Figure 3:
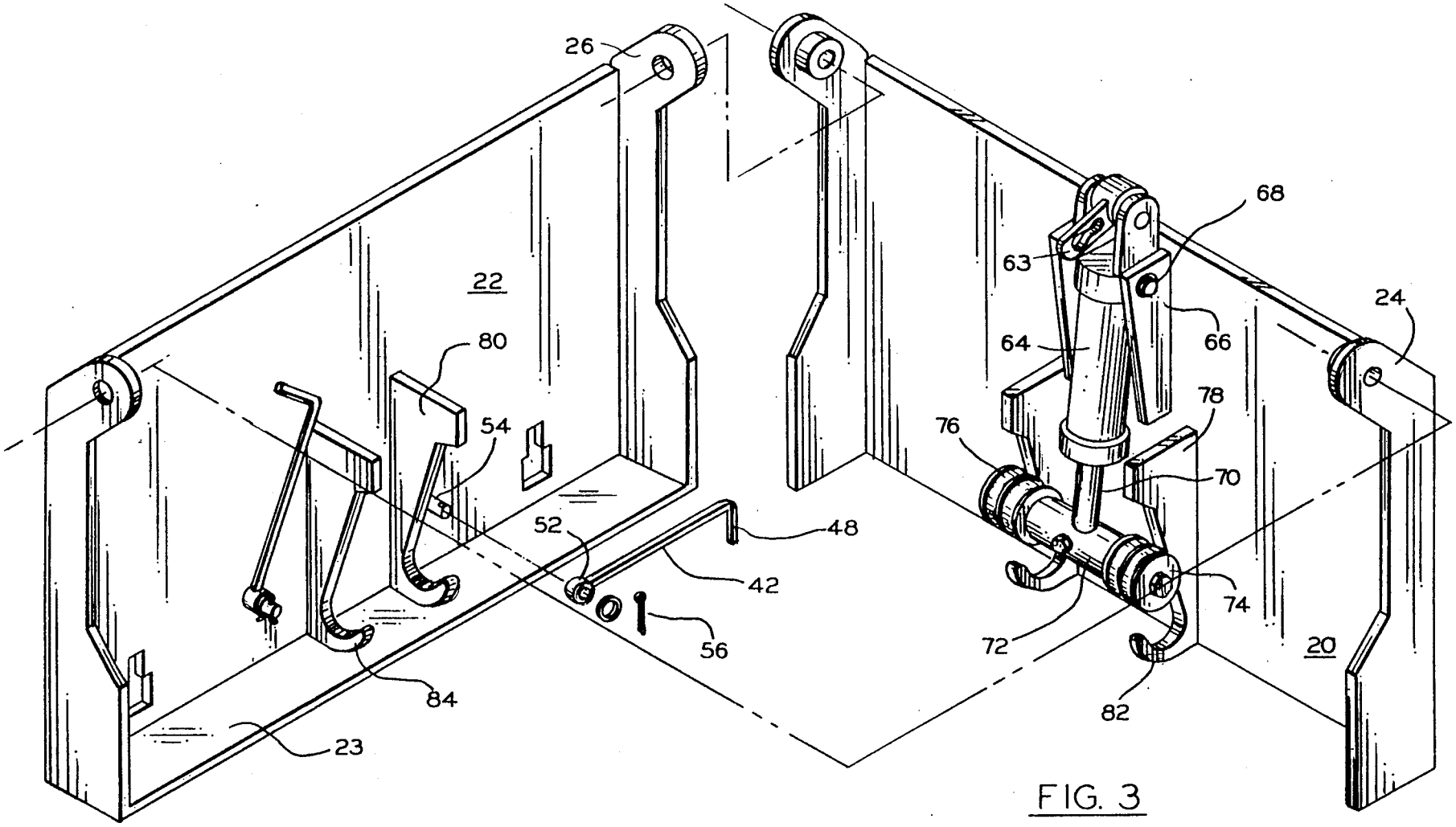
FIG. 3 is an exploded view of the clam-shell mounting plates of FIG. 2.
Figure 4:
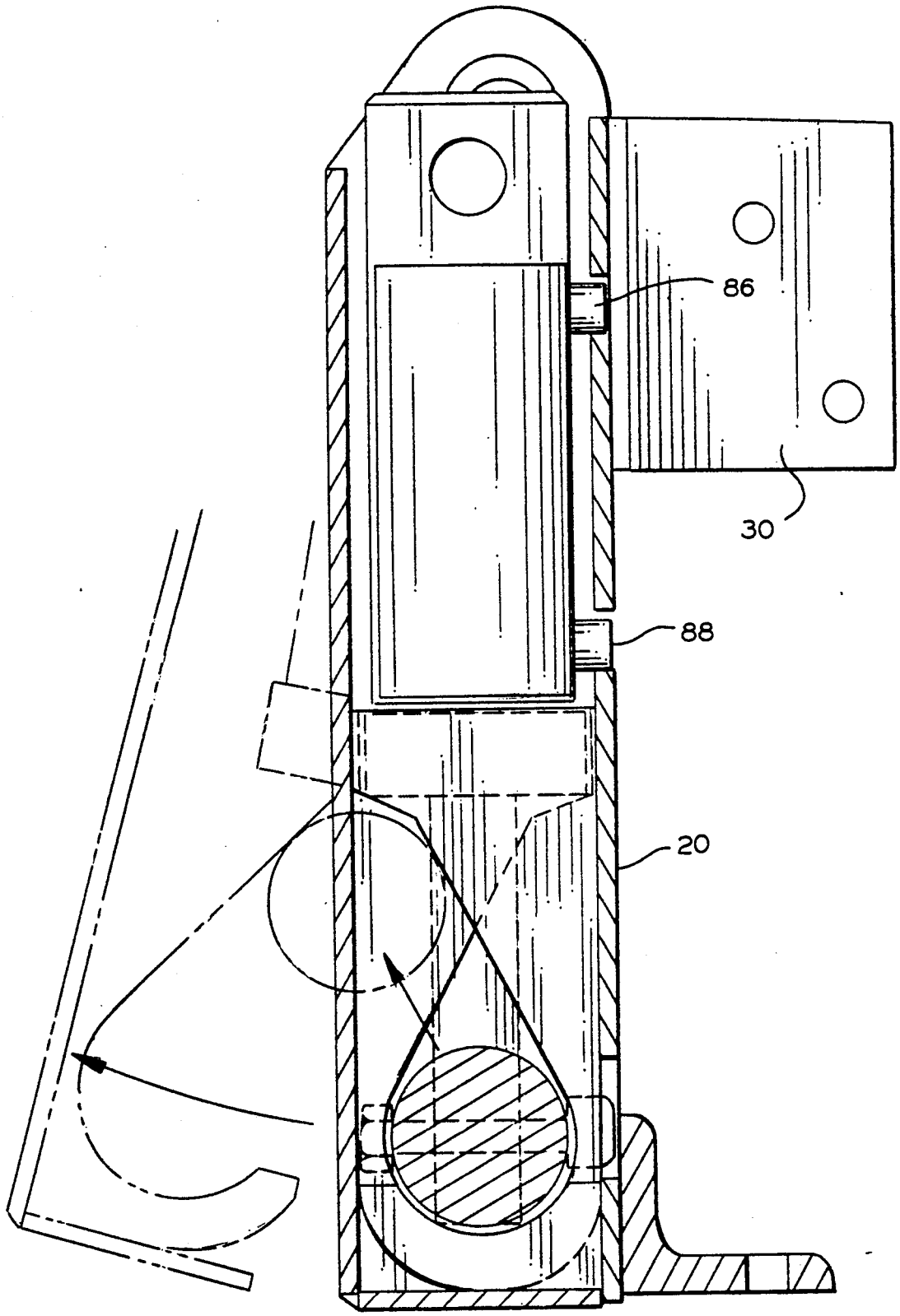
FIG. 4 is a side elevation, partially in section, of the actuating cylinder showing the interaction with the cam surfaces for actuation of the raising and lowering function.

This construction has an advantage of allowing connection in an automatic fashion since gravity will hold the arms 42 in a downward position and the truck may then be driven onto the plow so that the bayonet arrow heads enter the slot and force the arms 42 upwardly until they can fall back into the slot 44 as shown in FIG. 4 to secure the frame members 14 in the plate 22. Auxiliary support for the blade in the form of a chain 60 is secured to the forward end of the frames 14 and then releasably inserted in the slotted bale 62 mounted on one of the mounting brackets for the bumper 34 on plate 22. This may be seen in FIG. 1. Alternatively, the bale 63 may be pivoted about a pin mounted on the top of the hydraulic cylinder 64 mounted on the inner plate 20 as can be seen in FIGS. 2 and 3.

Referring now to FIGS. 2 and 3, the actuating mechanism for lifting the plow from contact with the surface being plowed, includes a cylinder 64 mounted at its upper end in brackets 66 adjacent the top edge of the plate 20. The cylinder 64 is pivoted about the trunnions 68 for rotation thereabout when actuated. The cylinder 64 extends downwardly and has on the distal end of piston rod 70 a cross bar 72 which carries on each end cam followers 74 and 76. Also mounted on the plate 20 is a pair of cam members 78 which have a ramp surface extending upwardly and outwardly from the bottom of the plate 20, as may be seen in FIG. 3. A complimentary pair of cam members 80, is mounted in a similar fashion on plate 22 such that when the clamshell plates are closed together, two pairs of cam surfaces 78 and 80 enclose the cam followers 74 and 76 therebetween. The surfaces 78 and 80 are provided at the lower end with a hook portion 82 and 84 such that when hydraulic pressure is applied to this cylinder 64 and the piston is extended to its fullest length, the cam followers 74 and 76 will lock the two cam surfaces 80 and 78 together to hold the two plates in a closed clam-shell position.

When it is desired to actuate the mounting apparatus to elevate the plow from the surface being plowed, hydraulic pressure is applied to the cylinder 64 to retract the piston rod 70 and the cam followers 74 and 76 are then caused to ramp up the sloping surfaces of the pair of cams 78 and 80 and in so doing to cause the plate 22 to move outwardly pivoting about the ears 24 and 26 to the position shown in dotted lines in FIG. 4. In this position the plow blade 12 will be raised to the position shown in dotted lines in FIG. 1, well clear of the surface being plowed. The cylinder 64 is supplied through hose ports 86 and 88 by a hydraulic supply, not shown, for actuation to either the retracted or extended configuration.

While not shown, the plow frame 14 and the plow blade 12 can incorporate the usual hydraulic cylinders for left to right pivotal adjustment for discharging of snow to one side or the other, as is well known in the art.

The cylinder 64 and cam and follower construction provides a positive, simple means of raising and lowering the plow blade 12 and also a positive locking of the two plates 20 and 22 together for times when the plow blade has been removed and the vehicle is being used for other purposes.

As may be seen in FIG. 1 when the blade is removed from the clam-shell mounting apparatus, the bumper 34 extends forward of the rest of the apparatus and provides the usual function of the front bumper of a truck. There is no hydraulic cylinder or mounting arms or levers extending forward of the bumper surface that could in any way damage or interfere with another vehicle or structure should the truck happen to be driven into such an object. It also is apparent from a review of the drawings that the chain 60 and the frame portions 14 and 16 can be quickly and easily detached from the plate 22 so that the plow can be mounted and dismounted from the truck quickly and easily, providing greater versatility and utility for the truck.

While the invention has been described in the specification and illustrated in the drawings with reference to a preferred embodiment, it will be understood by those skilled in the art that various changes may be made and equivalents may be substituted for elements of the invention without departing from the scope of the claims.

What is claimed is

1. In a detachable snowplow installation on a truck for snowplowing and regular truck use when the plow is removed, snowplow mounting and control apparatus comprising:

a first frame member adapted to be mounted at the front of the truck in place of the usual front bumper;

a second frame member adapted to be pivotally mounted on said first frame member about the upper edge thereof;

said second frame member having mounting means adapted to secure the usual front truck bumper thereto;

means for releasably securing to said second frame member a third frame member having mounted thereon a snowplow blade;

fluid cylinder means connected between said first and second frame members for pivotally moving said second frame member relative to said first frame member, whereby said third frame member and snowplow blade may be raised and lowered into and out of plowing position when mounted on said second frame member.

2. Snowplow mounting and control apparatus as described in claim 1 wherein said first and second frame members comprise rectangular plates having side and bottom flanges disposed at right angles thereto; and said side flanges are pivotally connected at the upper corners thereof to form an enclosure between said plates when positioned in the closed parallel position.

3. Snowplow mounting and control apparatus as described in claim 1 wherein said fluid cylinder means includes:

a hydraulic cylinder having one end thereof mounted on said first plate and having cam follower means mounted on the other end thereof, said cylinder being positioned within the enclosure formed by said first and second plates;

a first pair of cam members mounted on said first plate within the enclosure formed by said first and second plates;

a second pair of corresponding cam members mounted on said second plate within the enclosure formed by said first and second plates; and said first and second cam members being mounted so as to be engaged by said cam follower means when said hydraulic cylinder is actuated whereby said second plate may be pivotally rotated to an acute angle relationship to said first plate.

4. Snowplow mounting and control apparatus as described in claim 3 further including:

said hydraulic cylinder being mounted adjacent the upper edge of said first plate;

said first and second pair of cam members being mounted adjacent the bottom edge of said first and second plates respectively, having upwardly and inwardly extending ramp portions whereby as said hydraulic cylinder is retracted from the extended to closed position, said first and second plates are forced to pivot apart as said cam followers ride up between said first and second pairs of cam members.

5. Snowplow mounting and control apparatus as described in claim 1 further including:

a pair of slots cut in said second plate adjacent the bottom corners thereof;

a pair of slotted bayonet members on said third frame member adapted to be positioned in said second plate slots;

a pair of pivotally mounted bars adapted to be selectively rotated into said slotted bayonet members to lock said third frame members in engagement in said second frame member.

6. Snowplow mounting and control apparatus as described in claim 5 further including chain means releasably connected between the distal end of said third frame member and the top of said second frame member to provide a support for said plow blade and third frame member.

7. Snowplow mounting and control apparatus as described in claim 5 wherein said pivotally mounted bars are rectangular L-shaped bars secured to said second plate adjacent their straight ends.

8. A snowplow assembly for mounting on a truck of the type in which the blade may be easily removed comprising in combination:

first and second rectangular plates spaced apart and pivotally joined together along a top edge to form a clam-shell configuration;

said first plate being adapted to be mounted on the truck in place of the regular front bumper;

a plow blade releasably mounted on said other plate;

a hydraulic cylinder mounted on the inside of said bumper mounted plate;

cam means mounted on the inside of said rectangular plates;

cam followers mounted on the piston rod of said cylinder to engage said cam means; and means for actuating said cylinder to cause said cam followers to engage said cam means to open said rectangular plates in clam shell fashion to raise the plow blade from the ground.

9. Snowplow mounting and control apparatus as described in claim 8 further including means on the second plate for mounting the regular truck front bumper whereby when said plow blade is removed, the front bumper can function in its intended fashion without interfering snowplow apparatus protrusions.

* * * * *